US006091919A

United States Patent [19]

Nozawa et al.

[11] Patent Number: 6,091,919

[45] Date of Patent: Jul. 18, 2000

[54] DEVELOPER CARTRIDGE AND IMAGE FORMING APPARATUS

[75] Inventors: Ken Nozawa; Atsushi Kurabayashi; Yoshiharu Momiyama, all of Tokyo, Japan

[73] Assignee: Oki Data Corporation, Tokyo, Japan

[21] Appl. No.: 09/178,694

[22] Filed: Oct. 26, 1998

[30] Foreign Application Priority Data

Oct. 30, 1997 [JP] Japan ..... 9-298426

[51] Int. Cl.[7] ..... G03G 15/08

[52] U.S. Cl. ..... 399/262; 222/DIG. 1

[58] Field of Search ..... 222/DIG. 1, 12; 399/110, 119, 262

[56] References Cited

U.S. PATENT DOCUMENTS 5,078,303 1/1992 Kikuchi et al. ..... 222/DIG. 1

*Primary Examiner*—William Royer
*Assistant Examiner*—William A. Noe
*Attorney, Agent, or Firm*—Akin, Gump, Straus, Hauer & Feld, L.L.P.

[57] ABSTRACT

A developer cartridge is used with an image forming apparatus. The developer cartridge has a groove which formed in a longitudinal end surface of thereof and extends in an insertion direction of the cylinder. A strip-shaped projection formed in the image forming apparatus projects extends in the insertion direction. When the developer cartridge is fully inserted into the image forming apparatus, the groove receives the projection so that the projection is at a predetermined position relative to the developer cartridge. Two first walls define the groove which is progressively wide as the circumference is approached. A second wall rises from the longitudinal end surface of the developer cartridge and is continuous with one of the two first opposed walls. The second wall smoothly guides the projection into the groove.

13 Claims, 8 Drawing Sheets

DEVELOPER CARTRIDGE AND IMAGE FORMING APPARATUS

FIELD OF THE INVENTION

The present invention relates to a developer cartridge which is cylindrical in shape and fits to a projection formed on a cartridge receiving section, thereby being received in an image forming apparatus.

DESCRIPTION OF THE RELATED ART

A developer cartridge is a consumable item which is loaded into an image forming apparatus and supplies toner to the image forming apparatus. FIG. 10A illustrates a conventional cylindrical developer cartridge when it is attached to the image forming apparatus. FIG. 10B is a fragmentary cross-sectional view of a cartridge receiving section.

A cylindrical developer cartridge 100 holds developer toner, not shown, therein, and supplies toner to an image forming apparatus when the developer cartridge 100 is loaded in a cartridge-receiving section of the image forming apparatus 200. The cartridge 100 is formed with a groove 100*a* in a longitudinal end surface thereof. A cartridge receiving section 200*a* has a tapered projection 200*b*.

When loading the cartridge 100 into the cartridge receiving section 200*a*, the cartridge 100 is lowered in a direction shown by arrow A so that the projection 200*b* enters the groove 100*a*. The tapered shape of the projection 200*b* serves to properly guide the projection 200*b* into the groove 100*a* so that the cartridge 100 is smoothly received into the cartridge receiving section 200*a*.

The width of the groove 100*a* is only slightly greater than that of the projection 200*b*. Therefore, if the cartridge 100 is inserted into the cartridge receiving section with the groove 100*a* laterally offset from the projection 200*b*, the tapered shape of projection 200*b* is not effective enough in guiding the cartridge 100 into the cartridge receiving section 200*a*.

SUMMARY OF THE INVENTION

An object of the invention is to provide a developer cartridge and an image forming apparatus where the developer cartridge can be loaded without difficulty.

A developer cartridge is used with an image forming apparatus. The cartridge is in the shape of a cylinder. The cylinder extends in a longitudinal direction and has a groove formed in a longitudinal end surface of the cylinder. The groove generally extends in an insertion direction of the cylinder in which the cartridge is inserted into the image forming apparatus, and receives a projection formed in the image forming apparatus when the cartridge is inserted into the image forming apparatus. The projection projects in the longitudinal direction and extends in the insertion direction. The groove guides the projection to a predetermined position relative to the cartridge when the cartridge is fully inserted into the image forming apparatus. Two first walls define the groove therebetween so that the groove tapers in width towards the center of the cylinder. The first walls oppose each other and are at an angle with the insertion direction of the cartridge so that the groove is progressively wide with increasing distance from a center of the cylinder. A second wall rises from the longitudinal end surface of the cartridge and is continuous with one of the two first opposed walls.

The cartridge has a circumferentially curved wall. The projection extends in the insertion direction and has a forward end and rearward end. The rearward end is substantially configured to the inner surface of the circumferentially curved wall.

The cartridge includes a third wall which rises from the longitudinal end surface and is continuous with said second wall. The third wall extends substantially parallel to the insertion direction and slidingly engaging the projection when the cartridge is fully inserted into the image forming apparatus.

The projection tapers at its forward half to correspond to the width of the groove at a distance away from the center of the cylinder since the groove tapers in width toward the center of the cylinder. In this way, the projection will not completely project into the groove unless it is a predetermined distance away from the center of the cylinder.

The groove has a bottom surface beveled so that the groove is deeper near the circumference of the cylinder.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be described in detail with reference to the drawings.

First Embodiment

Figure 1:
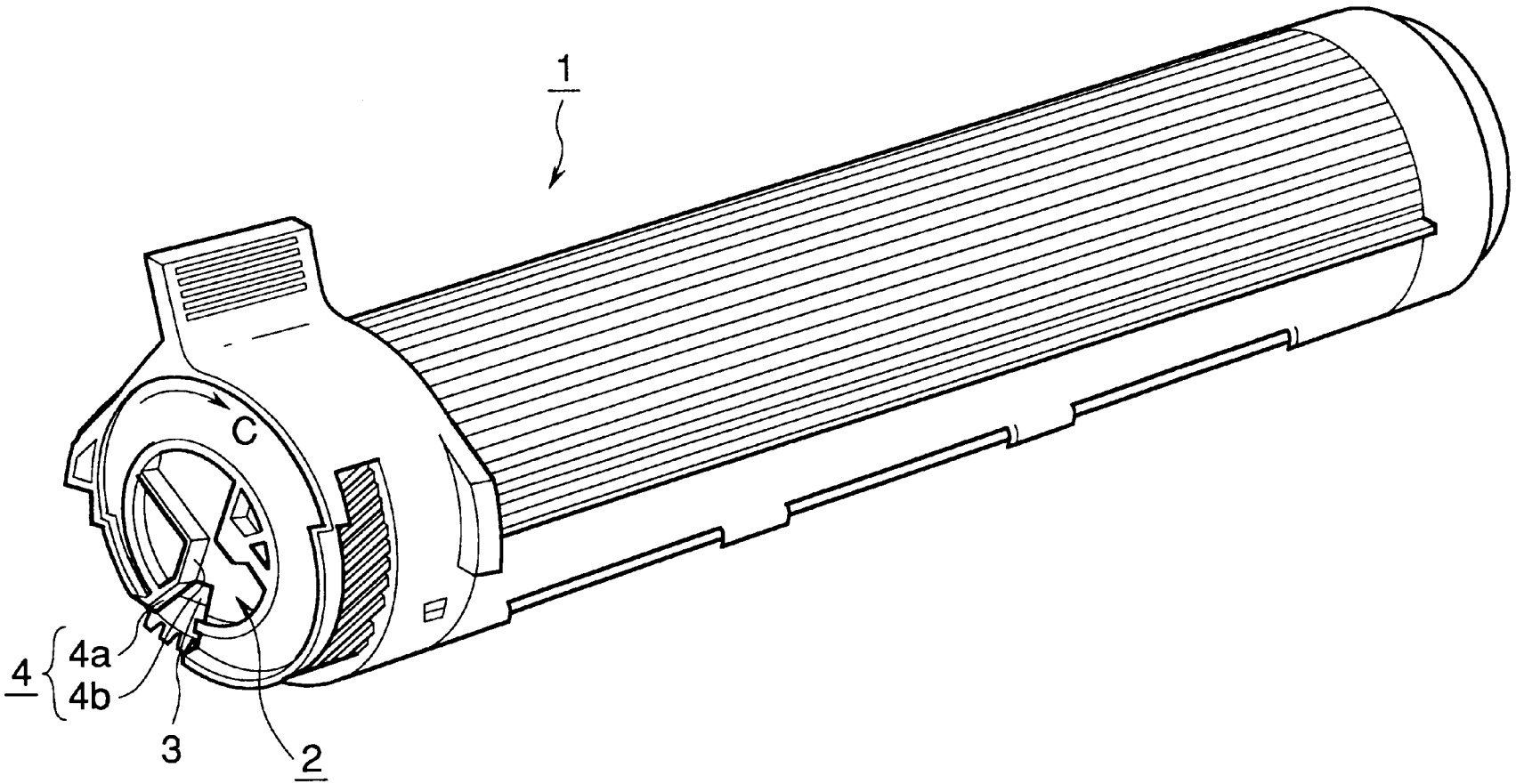
FIG. 1 is an enlarged perspective view of a developer cartridge according to a first embodiment of the invention.
Figure 2:
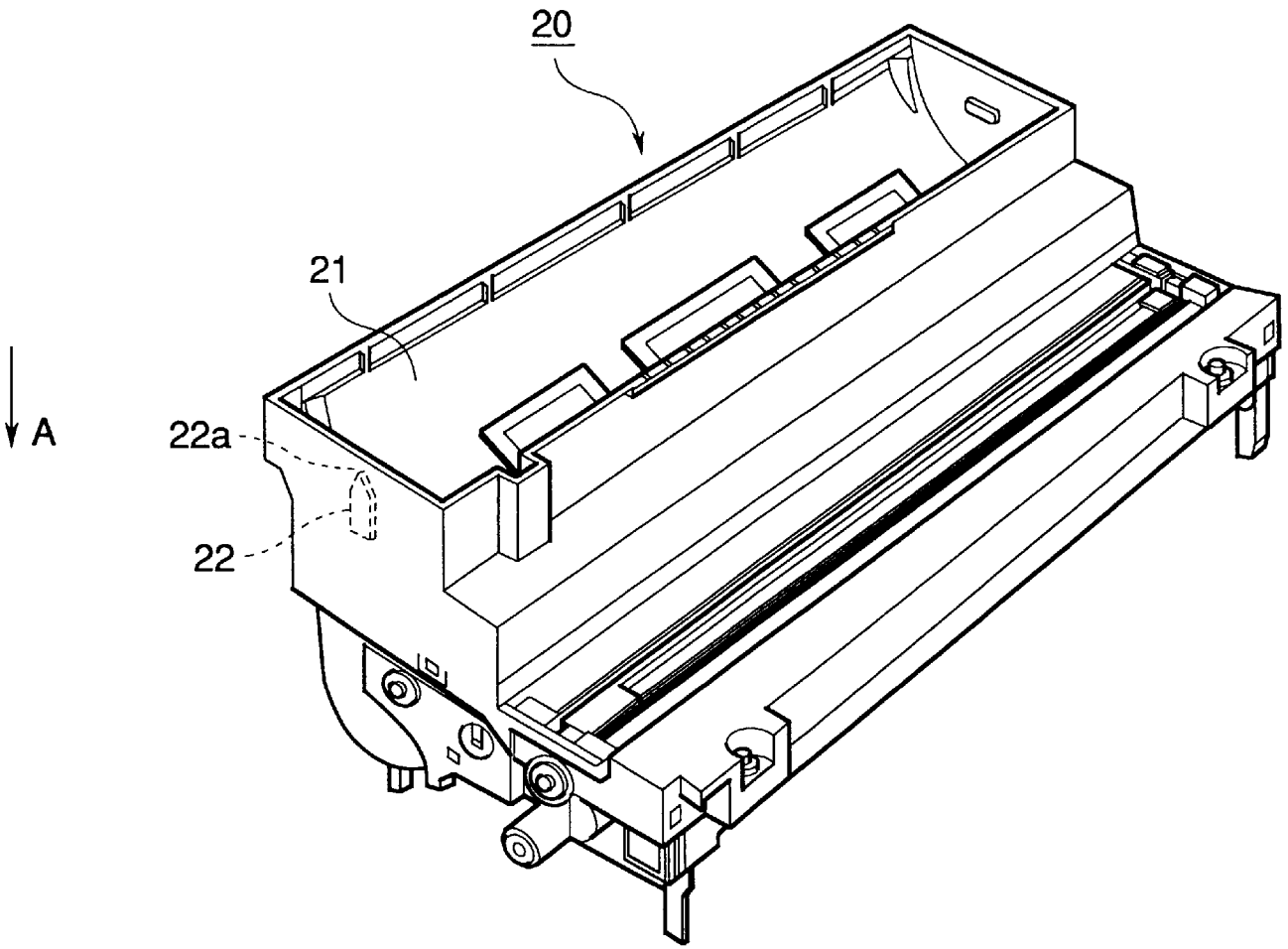
FIG. 2 is a general perspective view of an image forming apparatus according to the first embodiment.

FIG. 1 is an enlarged perspective view of a developer cartridge according to a first embodiment of the invention. FIG. 2 is a general perspective view of an image forming apparatus according to the first embodiment.

A developer cartridge 1 is generally in the form of a cylinder and holds developer toner, not shown. The developer cartridge 1 has a mounting construction 2 by which the developer cartridge 1 is loaded into an image forming apparatus 20 shown in FIG. 2. The mounting construction 2 is formed with a groove 3 in a longitudinal circular end surface 2A thereof, the groove 3 radially extending and opening to a circumferential edge 3*a* of the cylindrical developer cartridge 1. The image forming apparatus 20 has a cartridge receiving section 21 in which the developer cartridge 1 is received. The cartridge receiving section 21 has a strip-like projection 22 which has an upwardly tapered tip 22*a*.

The shape of the groove 3 will be described with reference to FIGS. 3A–3B and 4A–4B. The groove 3 is defined by two opposing wall surfaces 3*c* and 3*d* and a beveled bottom 3*a*. Wall surface 3*c* is continuous with a guide wall 4 which rises from the longitudinal end surface 2A and has first and second surfaces 4*a* and 4*b*, respectively. The surface 4*b* extends in a direction of insertion of the cartridge 1 while the surface 4*a* extends in such a direction as to widen the groove 3 with increasing distance away from the center of the end surface 2A. In other words, the groove 3 tapers toward the center of the end surface 2A so that the groove 3 progressively narrows toward the center of the circular longitudinal end surface 2A. The surface 4*a* makes an angle of θ1 with the direction of insertion A of the projection 22. The angle θ1 is preferably larger than a taper angle of the tip 22*a* of the projection 22*a* and less than the taper angle of the tip 22*a* plus 30 degrees.

After having been fully inserted into the cartridge receiving section, the cartridge 1 is rotated through a predetermined angle θ2 with the projection 22 engaging the longitudinal end surface 2A, thereby being completely loaded into the cartridge receiving section 20. The mounting construction 2 has a wall 5 which rises from the longitudinal end surface 2A and extends radially. The wall 5 has a stopper surface 5*a* which abuts the projection 22 to limit the rotation of the developing cartridge 1 when the cartridge 1 is rotated by the predetermined angle. The mounting construction 2 also has a circumferential wall 6 which tapers toward its free end near the groove 3. When the cartridge 1 has been completely received in the cartridge receiving section 20, the tip portion 22*a* of the projection 22 extends into a space between the surface 4*b* and the stopper surface 5*a*. A part of the groove 3 near the surface 4*a* is wider than the width W of the projection 22, so that there is a sufficient clearance between the projection 22 and the surface 4*a* for smooth advancement of the projection 22 into the space between the surface 4*a* and the stopper surface 5*a*.

The surface 4*b* extends over a distance longer than the width W of the projection 22. The distance is an experimentally determined value such that when the projection 22 has passed through the groove 3 into contact engagement with the longitudinal end surface 2A, the surface 4*b* engages the projection 22 to support the cartridge 1 in a stable position. The distance longer than the width W is necessary in order to support the projection 22 when the cartridge 1 is rotated with the projection 22 at the position shown in FIG. 3A.

The operation for loading the developer cartridge 1 according to the first embodiment into the cartridge receiving section 20 will be described with reference to FIGS. 3A–3B and 4A–4B.

The user holds the developer cartridge 1 with the mounting construction 2 directly above the projection 22. Then, the cartridge 1 is lowered in the insertion direction shown by arrow A. If the cartridge 1 is slightly laterally offset from the projection 22, then the surface 4*a* abuts the tip 22*a* of the projection 22. The cartridge 1 is then guided by the tip 22*a* in such a way that the tip 22*a* advances toward the space between the surface 4*b* and the stopper surface 5*a*. At this time, the bottom 3*a* of the groove 3 is also helpful in guiding the cartridge 1. When the tip 22*a* enters the space between the surface 4*b* and the stopper surface 5*a*, the insertion of the cartridge is completed.

Figure 3A:
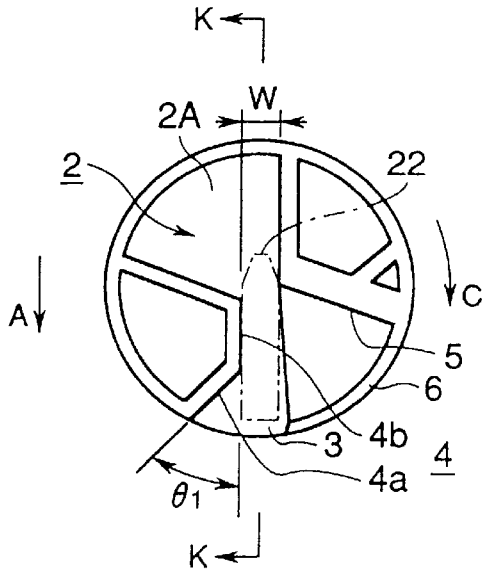
FIG. 3A is an illustrative diagram showing a mounting construction of the developer cartridge of the first embodiment.
Figure 3B:
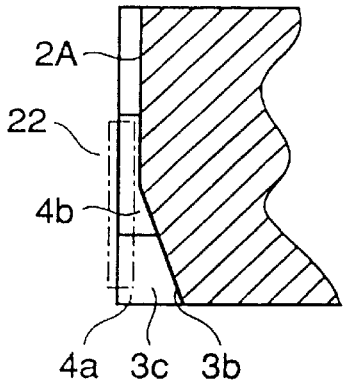
FIG. 3B is a cross-sectional view of the mounting construction taken along lines K—K of FIG. 3A.
Figure 4A:
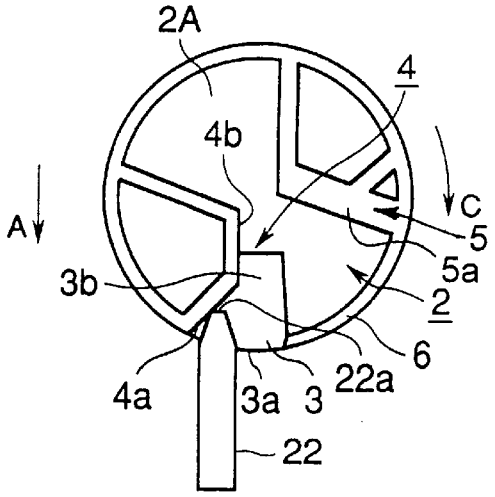
FIGS. 4A–4B illustrate the loading operation of the developer cartridge of the first embodiment.
Figure 4B:
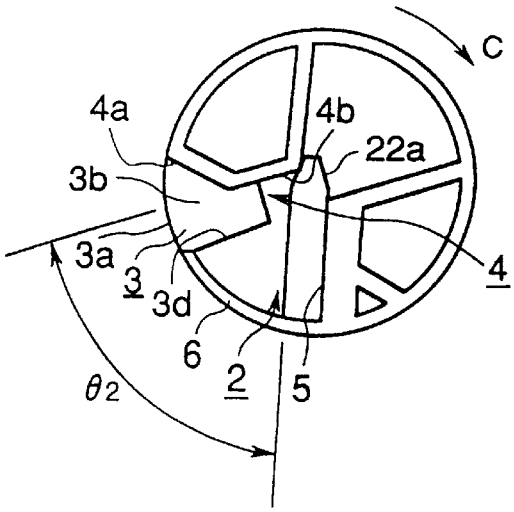
Figure 5:
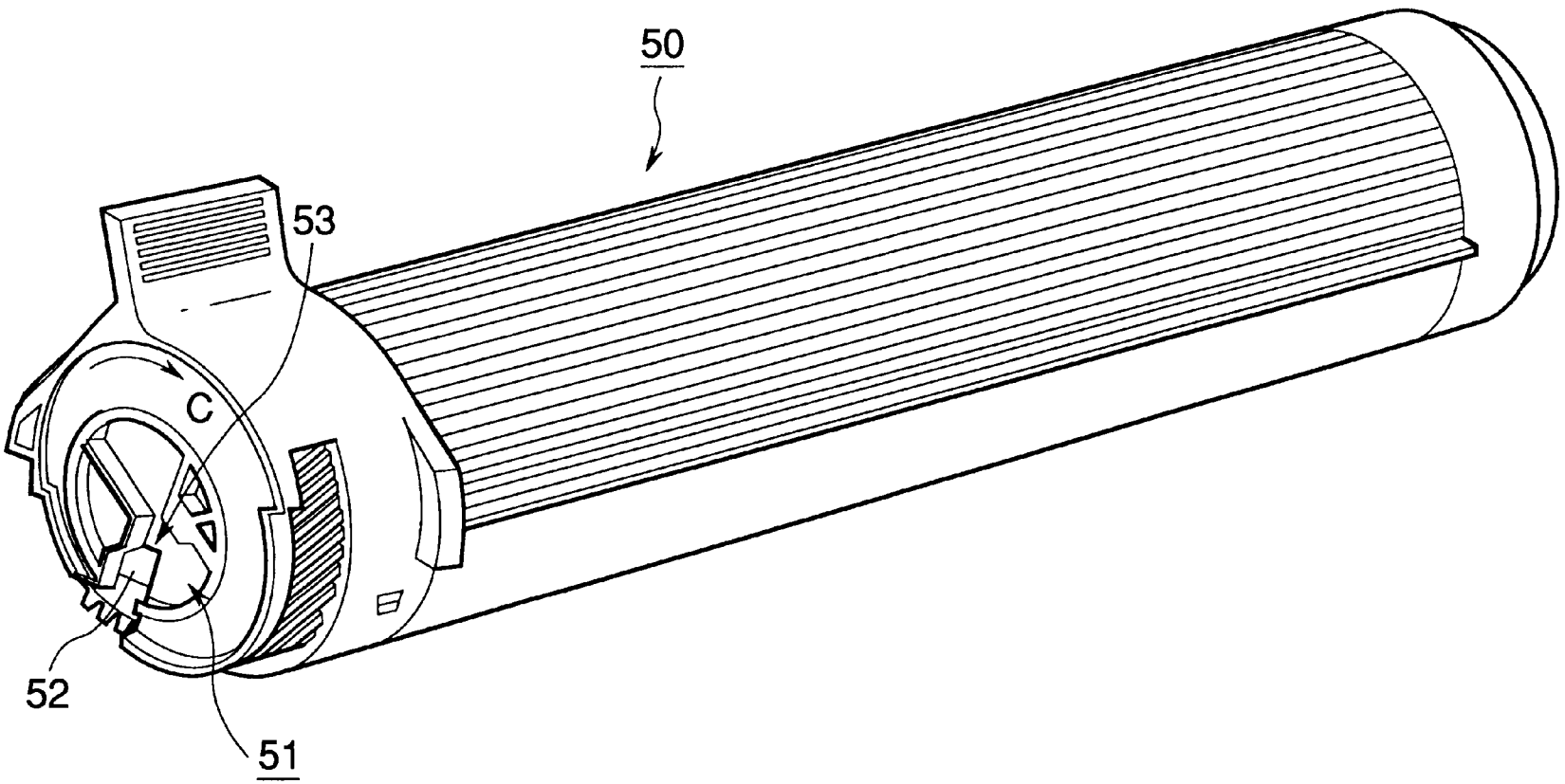
FIG. 5 is an enlarged view of a developer cartridge according to a second embodiment.
Figure 6:
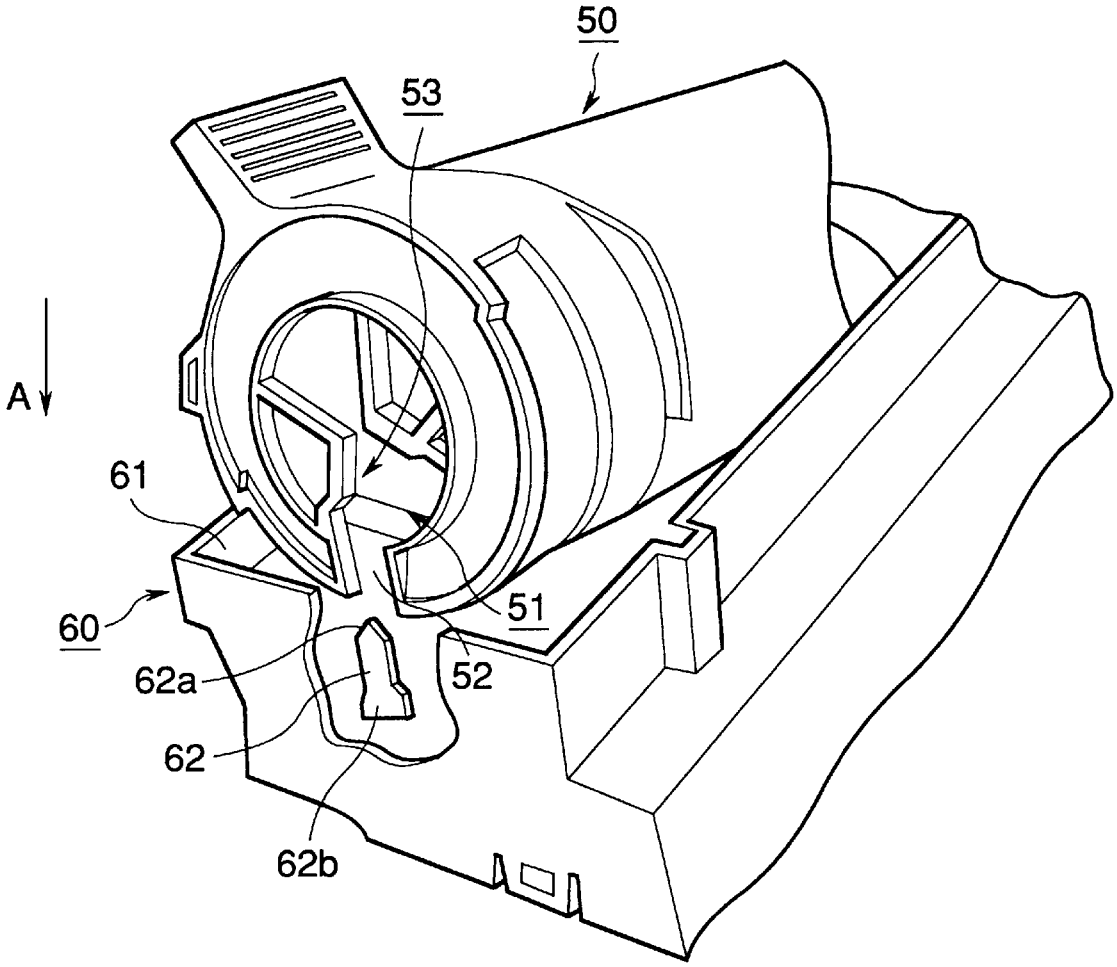
FIG. 6 is an illustrative diagram with a partial cutaway view, showing the loading of the cartridge into an image forming apparatus.

Then, the user rotates the developer cartridge 1 in a direction shown by arrow C in FIG. 3A. After having rotated through the predetermined angle θ2, the projection 22 abuts the stopper surface 5*a* to prevent the cartridge 1 from further rotation. This completes the loading operation of the cartridge 1.

When removing the developer cartridge 1 from the image forming apparatus, the above mentioned procedure can be performed in the reverse order.

Second Embodiment

The developer cartridge according to a second embodiment has a surface that corrects the position of a developer cartridge when the developer cartridge is inserted with its position offset from the correct position.

The second embodiment will be described with reference to FIGS. 5, 6, and 7A–7B.

A developer cartridge 50 holds developer toner, not shown, just as in the first embodiment. The cartridge 50 has a mounting construction 51 via which the cartridge 50 is loaded into the image forming apparatus 60. The mounting construction 51 has a groove 52 formed therein that extends radially outwardly and opens to the circumferential edge 52*b* of the mounting construction 51. The groove 52 has a beveled bottom 52*a* such that the groove 52 is deepest nearer the circumference edge 52*b*.

The image forming apparatus 60 has a cartridge receiving section 61 similar to the cartridge receiving section 21 of the first embodiment. The cartridge receiving section 61 has a projection 62 (FIG. 8A) in place of the projection 22 of the first embodiment. The projection 62 differs from the projection 22 in that the projection 62 has a base 62*b* which has an arcuate end surface 62*f*. The base 62*b* has a width W' larger than the width W of the projection 62. The projection 62 and base 62*b* project from the cartridge receiving section 61. The projection 62 has a beveled surface 62*e* substantially complementary with the surface 53*a* of an arcuate wall 53 of cartridge 50.

Figure 7A:
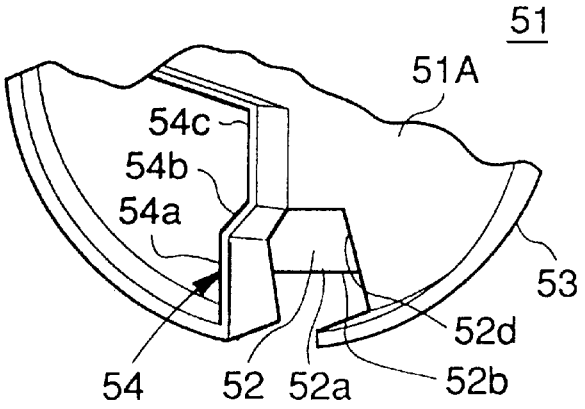
FIG. 7A is a partial perspective view of a mounting construction according to a second embodiment.

FIG. 7A is a fragmentary perspective view of the mounting construction 51.

Figure 7B:
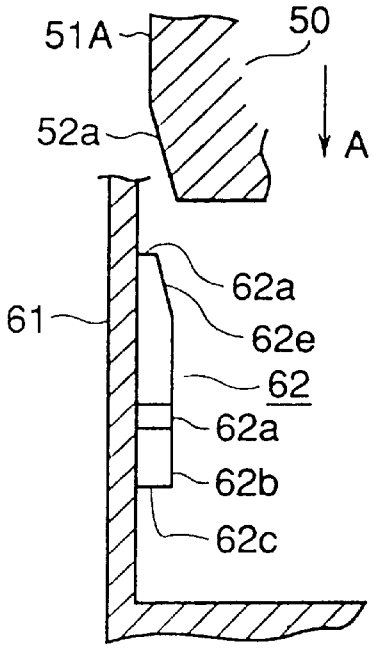
FIG. 7B is a partial cross-sectional view of the mounting construction and the image forming apparatus according to the second embodiment.
Figure 7C:
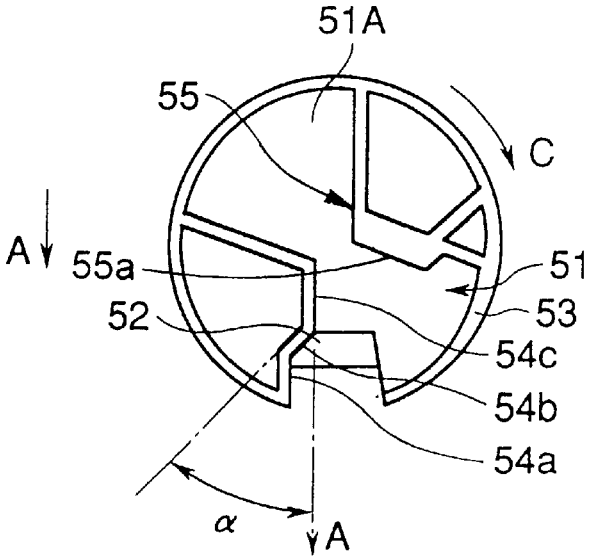
FIG. 7C is an illustrative diagram showing a mounting construction of a developer cartridge according to the second embodiment.

FIG. 7B is a cross-sectional side view of the cartridge receiving section 61 and cartridge 50.

The groove 52 of the mounting construction 51 will be described with reference to FIG. 7A. The mounting construction 51 has a guide wall 54 which rises from the longitudinal end surface 51A and includes surfaces first, second and third surfaces 54*b*, 54*a* and 54*c*, respectively and a stopper wall 55 having a stopper surface 55*a* which rising from the longitudinal end surface 51A. The surface 54*c* and the surface 54*a* extend in directions substantially parallel to a direction of insertion shown by arrow A, but are offset from each other. The surface 54*c* extends over a distance longer than the width W of the narrow projection 62 for the same reason as in the first embodiment. The surface 54*b* makes an angle a with the direction of insertion shown by arrow A of the cartridge in such a way that the surface 54*b* widens the groove 52 with increasing distance from the center of the circular longitudinal end surface 51A of the cartridge 50. In other words, the groove 52 tapers radially inwardly. The angle $\alpha$ is preferably the same as the angle $\theta 2$ in the first embodiment. The circumferential wall 53 also rises from the end surface 51A and tapers toward its free end near the groove 52.

The cartridge 50 is placed in the cartridge receiving section 61 with the projection 62 fitting into the groove 52. Then, the cartridge is rotated in a direction shown by arrow C. This completes the loading of the cartridge 61. The arcuate surface 62*f* smoothly slides on the inner surface of the circumferential wall 53, allowing the cartridge 50 to rotate smoothly. When the cartridge 61 is rotated through a predetermined angle $\theta 2$, the stopper surface 55*a* of wall 55, abuts the projection 62 to prevent further rotation of the cartridge 50. The stopper surface 55*a* is configured to the contour or outline of the projection 62 and base 62*b* and therefore not flat so that the stopper surface 55*a* is complementary to the projection 62.

A space between the surface 54*c* and the stopper surface 55*a* is such that only the narrow projection 62 having a width W can loosely fit. The width of the groove 52 near the circumference of the cylindrical cartridge 50 is slightly larger than the width of the base 62*b*.

The rest of the construction is the same as that of the first embodiment and the description thereof is omitted.

Figure 8A:
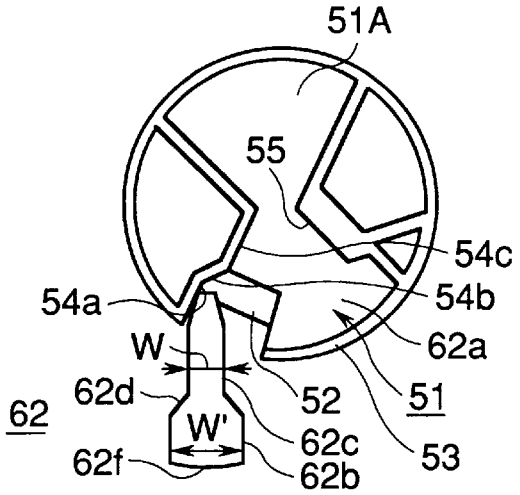
FIGS. 8A–8C are illustrative diagrams showing the procedure of loading the developer cartridge of the second embodiment.
Figure 8B:
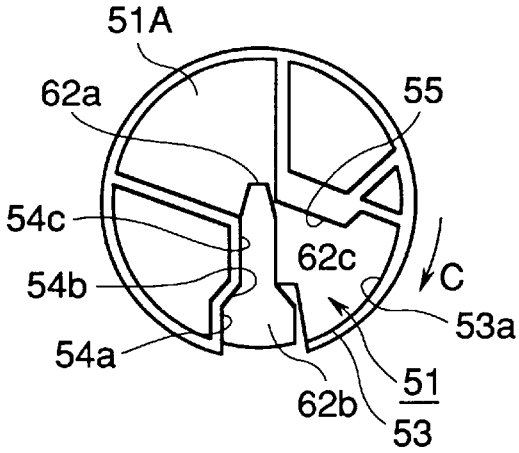
Figure 8C:
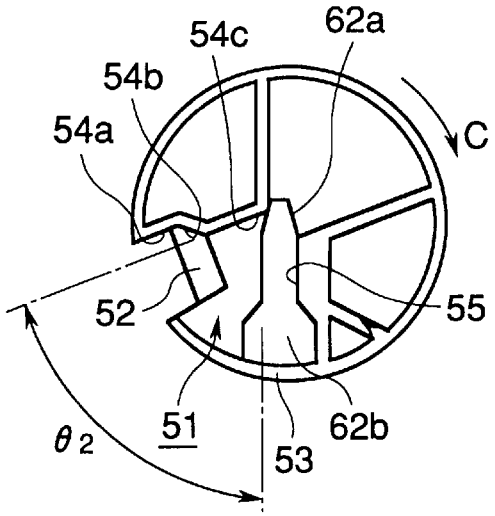

FIGS. 8A–8C are illustrative diagrams showing the procedure of loading the developer cartridge of the second embodiment.

The loading operation of the developer cartridge will be described with reference to FIGS. 8A–8B and 9.

The user holds the cartridge 50 with the mounting construction 51 directly above the projection 62. Then, the cartridge is lowered in the direction shown by arrow A so that the projection 62 enters the groove 52. The beveled surface 62*e* cooperates with the beveled surface 52*a* of the cartridge 50 in such a way that one surface slides over the other for smooth insertion of the projection 62 into the groove 52. If the tip 62*a* of the projection 62 abuts the surface 54*a* or 54*b*, the surface corrects the insertion direction of the cartridge 50 projection 62 so that the cartridge 50 is properly guided by the projection 62. Thus, the tip 62*a* smoothly enters the space between the surface 54*c* and stopper surface 55*a*.

When the tip 62*a* enters the space between the surface 54*c* and the stopper surface 55*a* and the base 62*b* abuts the surface 54*b*, the cartridge has been completely inserted as shown in FIG. 8B. The projection 62 is configured to the shape of the wall 54.

Then, the user rotates the cartridge 50 in a direction shown by arrow C just as in the first embodiment. After the cartridge has been rotated through a predetermined angle $\theta 2$, the stopper surface 55*a* abuts the projection 62, thereby limiting the a further rotation of the cartridge. This completes the loading of the cartridge.

When removing the developer cartridge 50 from the image forming apparatus, the above mentioned procedure can be performed in the reverse order.

Figure 9:
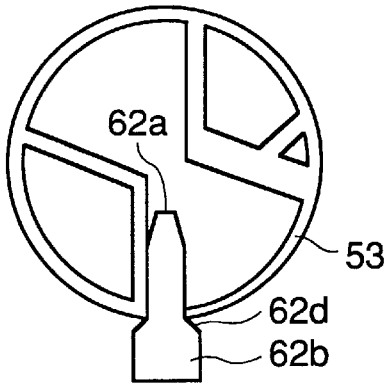
FIG. 9 shows examples of drawbacks when an inappropriate developer cartridge is accidentally inserted into the image forming apparatus according to the second embodiment.
Figure 10A:
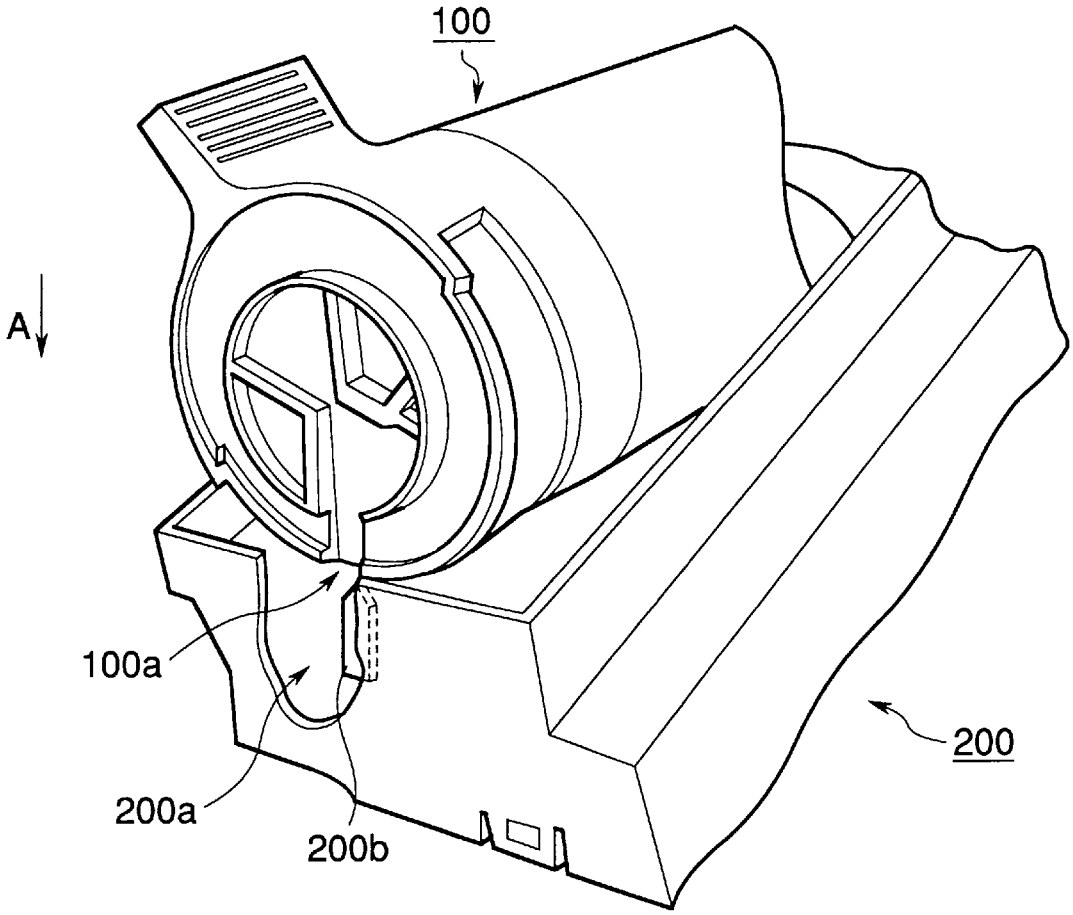
FIG.10A CONVENTIONAL ART
FIG. 10A illustrates a conventional developer cartridge when it is loaded into the image forming apparatus.
Figure 10B:
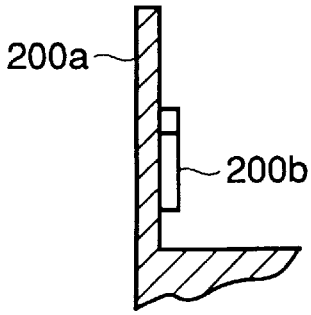
FIG.10B CONVENTIONAL ART
FIG. 10B is a partial cross-sectional side view of the cartridge receiving section.

FIG. 9 shows a drawback, by way of example, when an inappropriate developer cartridge is accidentally inserted into the image forming apparatus according to the second embodiment.

The second embodiment is advantageous in that if a user attempts to load a cartridge having a groove narrower than the groove 52, the cartridge abuts the base 62*b*, preventing the cartridge from being inserted any further. This construction effectively prevents the user from loading an inappropriate cartridge, protecting the user from poor print quality due to inadvertent use of inappropriate cartridge.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developer cartridge for use with an image forming apparatus, the developer cartridge comprising:

a body with an at least partially cylindrical portion, the partially cylindrical portion extending in a longitudinal direction and having a groove formed in a longitudinal end surface of the partially cylindrical portion, the groove receiving a strip-like projection formed on the image forming apparatus when the developer cartridge is inserted into the image forming apparatus, the projection extending in an insertion direction in which the developer cartridge is inserted into the image forming apparatus; and a first guide wall surface extending from the longitudinal end surface and defining the groove such that the groove opens to a circumference of the partially cylindrical portion, said first guide wall surface being at an angle with the insertion direction so that the groove is wider nearer the circumference.

2. The developer cartridge according to claim 1, further comprising:

a groove wall surface, said first guide wall surface and said groove wall surface opposing each other, and at least one of said first guide wall surface and said second groove wall surface being at an angle with the insertion direction of the developer cartridge.

3. The developer cartridge according to claim 2, further comprising:

a second guide wall surface which is continuous with said first guide wall surface and extends from the longitudinal end surface, said second guide wall surface extending substantially in the insertion direction so that said first guide wall surface is between the second guide wall surface and the circumference, the second guide wall surface slidingly engaging the projection when the developer cartridge has been fully inserted into the image forming apparatus.

4. The developer cartridge according to claim 3, further comprising:

a third guide wall surface which is continuous with said first guide wall surface and extends substantially parallel to the insertion direction so that said third guide wall surface is between the first guide wall surface and the circumference, wherein said first guide wall surface, said second guide wall surface, and said third guide wall surface form a shape complementary to the projection.

5. The developer cartridge according to claim 1, wherein the groove has a bottom surface which is beveled so that the groove is deeper nearer the circumference.

6. The developer cartridge according to claim 1, wherein said developer cartridge has a circumferentially curved wall which engages the projection so that rotation of the developer cartridge is guided along the circumferentially curved wall when the developer cartridge is rotated relative to the image forming apparatus after the developer cartridge has been fully inserted into the image forming apparatus.

7. An image forming apparatus comprising:

a developer cartridge, the cartridge having:

(i) a body having an at least partially cylindrical portion, the partially cylindrical portion extending in a longitudinal direction and having a groove formed in a longitudinal end surface of the partially cylindrical portion; and (ii) a first guide wall surface extending from the longitudinal end surface and defining the groove such that the groove opens to a circumference of the partially cylindrical portion, said first guide wall surface being at an angle with an insertion direction of the developer cartridge so that the groove is wider nearer the circumference, the insertion direction being a direction in which the developer cartridge is inserted into the image forming apparatus;

a space for receiving the developer cartridge in the image forming apparatus; and a projection extending parallel to the insertion direction, said projection extending into the groove to place the developer cartridge in position within the image forming apparatus when the developer cartridge is placed into the space, said projection including a forward section having a first width, a rearward section having a second width wider than the first width, and an intermediate section having a third width varying from the first width to the second width, said first, second, and third widths extending perpendicular to the insertion direction and parallel to the longitudinal end surface.

8. The image forming apparatus according to claim 7, further comprising:

a groove wall surface, said first guide wall surface and said groove wall surface opposing each other, and at least one of said first guide wall surface and said groove wall surface being at an angle with the insertion direction of the developer cartridge.

9. The image forming apparatus according to claim 8, further comprising:

a second guide wall surface which extends from the longitudinal end surface and is continuous with said first guide wall surface, said second guide wall surface extending substantially parallel to the insertion direction so that said first guide wall surface is between the second guide wall surface and the circumference, said second guide wall surface slidingly engaging said projection when the developer cartridge has been fully inserted into the image forming apparatus.

10. The image forming apparatus according to claim 9, further comprising:

a third guide wall surface continuous with said first guide wall surface and extending substantially parallel to the insertion direction so that said third guide wall surface is between the first guide wall surface and the circumference, wherein said first guide wall surface, said second guide wall surface, and said third guide wall surface form a shape complementary to the projection.

11. The image forming apparatus according to claim 7, wherein the forward section is tapered so that said projection completely projects into the groove at a predetermined distance away from the center of the developer cartridge.

12. The image forming apparatus according to claim 7, wherein the groove has a bottom surface beveled so that the groove is deeper nearer the circumference.

13. The image forming apparatus according to claim 7, wherein said developer cartridge has a circumferentially curved wall and the rearward section of the projection has rearward end configured substantially to an inner surface of the circumferentially curved wall; and wherein the circumferentially curved wall engages the rearward end of the projection so that rotation of the developer cartridge is guided along the inner surface when the developer cartridge is rotated relative to the image forming apparatus after the developer cartridge has been fully inserted into the image forming apparatus.

* * * * *